United States Patent [19]

Spaeth

[11] Patent Number: 4,690,321

[45] Date of Patent: Sep. 1, 1987

[54] FOLDABLE QUICK PACK FOR FOODSTUFFS AND THE LIKE

[76] Inventor: Lolita Spaeth, Wendeberg 43, 3180 Wolfsburg, Fed. Rep. of Germany

[21] Appl. No.: 907,804

[22] Filed: Sep. 16, 1986

[30] Foreign Application Priority Data

Sep. 17, 1985 [DE] Fed. Rep. of Germany ..... 3533068

[51] Int. Cl.[4] ..... B65D 5/02

[52] U.S. Cl. ..... 229/40; 229/148; 229/44 R; 229/87 R

[58] Field of Search ..... 229/40, 52 B, 44 R, 229/148, 151, 87 R, 87 A, 87 B

[56] References Cited

U.S. PATENT DOCUMENTS

| | | | |
|---|---|---|---|
| 3,368,735 | 2/1968 | Levi | 229/40 |
| 3,623,650 | 11/1971 | Watts | 229/148 |
| 3,627,541 | 12/1971 | Farquhar | 229/40 |
| 4,090,607 | 5/1978 | McCall | 229/40 |
| 4,171,763 | 10/1979 | Card | 229/148 |

FOREIGN PATENT DOCUMENTS

| | | | |
|---|---|---|---|
| 1280135 | 10/1968 | Fed. Rep. of Germany | 229/148 |
| 2853983 | 6/1980 | Fed. Rep. of Germany . | |
| 8514040 | 8/1985 | Fed. Rep. of Germany . | |
| 7418932 | 12/1975 | France | 229/40 |

*Primary Examiner*—Willis Little

*Attorney, Agent, or Firm*—Schwartz, Jeffery, Schwaab, Mack, Blumenthal & Evans

[57] ABSTRACT

A stable box-like one-piece quick pack is formed from an inherently stiff but permanently bendable and shapeable flat material, with the pack comprising a baseplate, upwardly directed side walls extending from two opposite edges of said baseplate, and a rear wall which includes opposite a lid and a first front wall. The first front wall extends between a second front wall starting from the baseplate and the side edges of the side walls. Fold-over flaps formed on the side walls, and a push-in tongue provided on the second front wall extend into slits in the lid and in the first front wall, respectively. In one invention form, the flaps formed on the side walls are of a length greater than one-half the length of the front and back walls so as to overlap when folded toward each other, with one of the flaps being bent upwardly through a slit in the other flap to form a carrying handle.

4 Claims, 2 Drawing Figures

FOLDABLE QUICK PACK FOR FOODSTUFFS AND THE LIKE

BACKGROUND OF THE INVENTION

The present invention relates to a box-like quick pack, formed from a folded blank, for goods sensitive to pressure, particularly foodstuffs.

PRIOR ART

A quick pack of this general type is disclosed in German Design Application No. 85 14 040. This known pack is intended particularly for the protective packing of pastry products and provides the special advantage of being simple to form by folding and insertion operations from a one-piece folded blank, supplied flat, for the sale of goods in a shop, for example, in a bakery. In this known quick pack the first front wall, extending downward from the lid, carries the push-in tongue which is pushed into the slit provided in the baseplate, so that the push-in tongue can be folded over under the baseplate. When the quick pack is closed, the second front wall, which is foldably attached to the front edge of the baseplate, lies between the first front wall and those edges of the two side walls which face it. In addition, the fold-over flaps of the side walls are pushed through slits in at least one other side wall and/or the lid.

In this known arrangement the fastening of the lid has certain disadvantages. If the lid is lifted when the pack is closed, corresponding tractive forces act on the push-in tongue and tend to pull it out of its slit in the opposite direction to that in which it was pushed in. Moreover, the opening of the lid leads automatically to the unfastening of the two side walls and of the second front wall. It is also a disadvantage that when the pack is closed the push-in tongue lies free outside the actual pack and is thus unprotected.

German Offenlegungsschrift No. 28 53 983 discloses a carton of corrugated or solid cardboard in which the lid has a push-in tongue which is foldably attached to its front edge and is pushed behind the front wall of the box into the interior of the latter. For the purpose of fastening the lid, an insertion slit is provided in the push-in tongue and extends partly into the front lid edge region, while a fastening tongue extending from a top middle region of the front wall of the box can be inserted into said slit, said top middle region being adapted to be folded out of the front wall on a bottom fold line extending parallel to the bottom of the box.

This known box has only a single-layer front wall. This lid secures only itself, and thus does not serve to secure the side walls which have been folded upwards. Special means must therefore be provided for holding all four side walls in position. The fastening of the lid is complicated, since the push-in tongue extending from the lid and said fastening tongue must be pushed simultaneously into the interior of the box in directions at right angles to one another.

The problem underlying the invention is that of improving the quick pack first described above, while retaining its advantageous properties in respect of its strength.

SUMMARY OF THE INVENTION

In the box construction in accordance with the present invention, the lifting of the lid leads, in respect of the push-in tongue, only to forces directed at right angles to the direction of insertion of this tongue. The push-in tongue is therefore subjected to lighter loads and is no longer automatically pulled out of the slit cooperating with it when the lid is lifted. With the arrangement according to the invention the lid is supported on the baseplate by means of the first front wall foldably attached to its front edge, so that the strength and stability of the box are increased. In its closed position the lid at the same time also secures the two opposite side walls in their upwardly folded position.

In accordance with the invention, undercuts are advantageously made at the sides of the push-in tongue in order to form a clip-like fastening for the push-in tongue in its slit.

A further improvement of the fastening can be achieved if the fold-over flaps projecting through slits in the lid are folded towards one another and have a length of more than half the length of the rear and front walls, and if in the closed position the free end of one flap is pushed through a slit in the end region of the other flap. Such free end, when pushed through the slit of the one flap can then be folded upwards to provide a handle with a cutout being formed in the upwardly folded flap, the removal of which forms a finger opening. In this embodiment therefore the free end of the one flap when pushed through said slit and bent upwards forms a handle for the quick pack.

Another advantage of the invention is to be seen in the fact that the push-in tongue, although no longer lying free and unprotected outside the actual quick pack, nevertheless does not project in a disturbing manner into the interior of the pack, as it extends directly under the lid and thus above the goods. On its insertion therefore the push-in tongue cannot damage the goods, nor can it be impeded by the latter.

BRIEF DESCRIPTION OF THE APPLICATION DRAWINGS

Two embodiments of the invention, serving as examples, are shown in perspective in the drawings, in which:

FIG. 1 shows in solid lines a quick pack completely folded and assembled, with broken lines showing intermediate positions of the various parts of the flat material (for example, cardboard or plastic sheet) during the assembly, and FIG. 2 shows a modified embodiment shown similarly to FIG. 1.

DETAILED DESCRIPTION OF THE PREFERRED EMBODIMENTS

Figure 1:
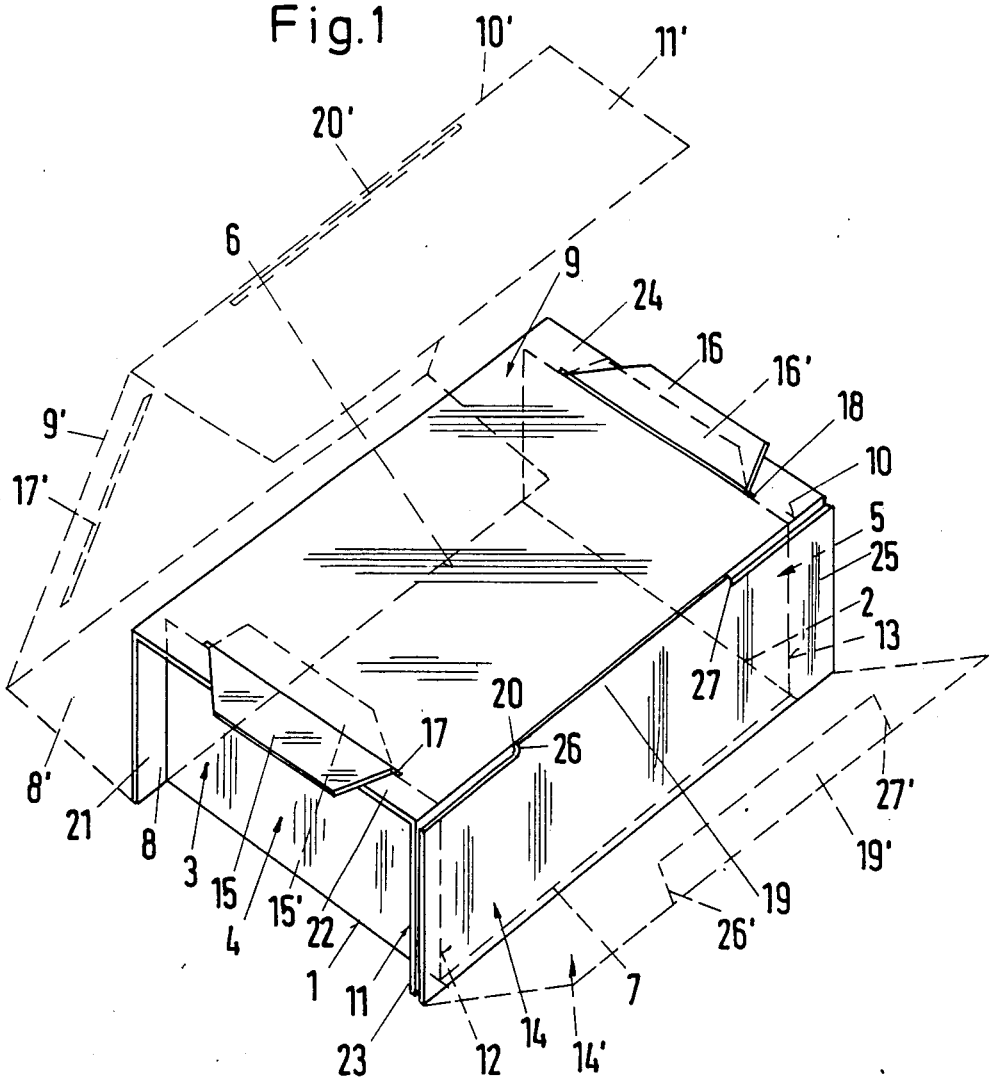

Referring to the FIG. 1 embodiment, starting from opposite edges 1, 2 of a baseplate 3 two side walls 4, 5 are folded upwards along fold lines coinciding with the edges. From one of the remaining edges 6, 7 of the baseplate 3 a rear wall 8 extends, continuing as a lid 9 from whose front edge 10 (which is in the form of a fold line) a first front wall 11 extends downward. The front wall 11 extends between the front surfaces of the side edges 12, 13 of the side walls 4, 5, on the one hand, and a second front wall 14, which is folded upwards from the edge 7 of the baseplate 3, on the other hand.

For the purpose of fastening the various parts, use is made of fold-over flaps 15, 16 on the top edges of the side walls 4, 5, these flaps being pushed through slits 17, 18, respectively, in the lid 9 and folded over parallel to and above the latter. A push-in tongue 19, which is provided on the top edge of the second front wall 14, is pushed into a slit 20 in the first front wall 11 near the lid 9 when the pack is folded. The rear wall 8, lid 9 and the first front wall 11 have portions 21, 22, 23, 24 and 25, which extend laterally outwardly beyond and are supported by the edges of the side walls 4, 5 for stiffening purposes.

Undercuts 26, 27 are formed on each side of the push-in tongue 19 of the second front wall 14 to engage the edge regions of the slit 20 and form a clip-like retention fastening.

Intermediate positions of the different parts in FIG. 1 are shown with identical reference numerals with primes. The side walls 4, 5 are first bent up to their end positions, but the flaps 15, 16 are not initially folded over horizontally. The rear wall 8, lid 9, and the first front wall 11 are then bent over the edges of the side walls 4, 5 and the flaps 15, 16 are pushed through the slits 17, 18. The second front wall 14 is then bent up from the plane of the baseplate 3, and the push-in tongue 19 pushed through the slit 20, with the undercuts 26, 27 retaining the second front wall 14 in its folded position. The flaps 15, 16 are then folded over into the positions shown in solid lines, thereby additionally improving the fastening of the lid 9.

Figure 2:
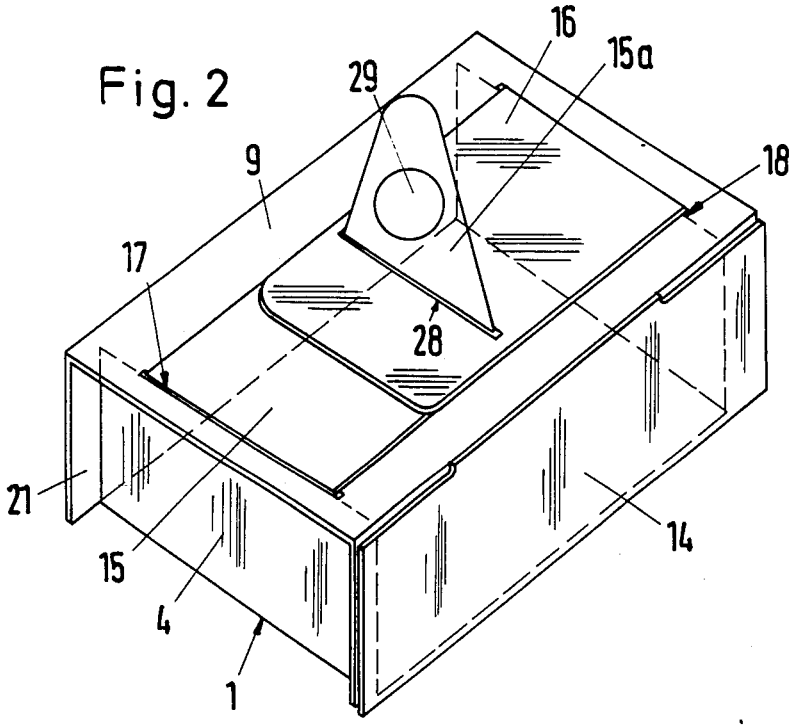

The embodiment shown in FIG. 2 differs from that shown in FIG. 1 only in respect of the shape of the fold-over flaps 15, 16. In the FIG. 2 embodiment, these flaps are folded over towards one another and have a length of more than half the length of the rear and front walls, so that the two flaps 15, 16 overlap in the middle region of the top. In the closed position the free end 15*a* of the one flap 15 is pushed through a slit 28 in the end region of the other flap 16. For the purpose of handling the quick pack, this free end 15*a* of the flap 15 is bent up into the position shown in FIG. 2, and thus serves as a handle for carrying the box. To make this easier, said free end 15*a* is provided with a cutout 29 which can be punched out to provide a finger grip.

What is claimed is:

1. A box-like quick pack, formed from a folded blank, for goods sensitive to pressure, particularly foodstuffs, comprising:

(a) a baseplate having front, side and back fold edges and having sufficient inherent stiffness to support the goods;

(b) two side walls directed substantially vertically upwards starting from two opposite side edges of the baseplate;

(c) a rear wall which starts from the rear edge of the baseplate and is directed upwards and which merges into a lid and front wall;

(d) side portions of said rear wall and lid overlapping the edges of the two side walls and projecting beyond the periphery of the baseplate;

(e) said side walls having fold-over flaps adapted to pass through slits formed in said lid;

f) said lid being extended at its front edge by a downwardly directed first front wall;

(g) a second front wall directed upwards and lying against the first front wall, said second front wall being foldably attached to the front edge of said baseplate;

(h) said first front wall extending between said second front wall and the front edges of said two side walls;

(i) a push-in tongue foldably attached to the top edge of said second front wall; and (j) a slit formed in said first front wall near the front edge of said lid and into which said tongue extends when the pack is assembled, and wherein (k) said fold-over flaps are sufficiently long that they can be folded over said lid to lie approximately parallel to it.

2. A quick pack as claimed in claim 1, wherein undercuts are made at the side of said push-in tongue to effect the clip-like fastening of said push-in tongue in said slit.

3. A quick pack as claimed in claim 1, wherein said fold-over flaps passing through the slits in the lid are folded towards one another and have a length of more than half the length of the rear and front walls, the free end of one flap when in a closed position being pushed through a slit formed in the end region of the other flap.

4. A quick pack as claimed in claim 3, wherein said free end of said one flap is pushed through said slit and folded upwards, said free end being provided a cutout, the removal of which provides a finger-opening handle for said pack.

* * * * *